US005894605A

United States Patent [19]

Chiang

[11] Patent Number: 5,894,605

[45] Date of Patent: Apr. 20, 1999

[54] NOSE BRIDGE STRUCTURE OF SWIMMING GOGGLES

[76] Inventor: Herman Chiang, 11F-2, No. 634-9, Ching-Ping Rd., Chung-Ho City Taipei Hsien, Taiwan

[21] Appl. No.: 08/891,685

[22] Filed: Jul. 11, 1997

[51] Int. Cl.[6] ..... A61F 9/02

[52] U.S. Cl. ..... 2/428; 2/445; 351/128

[58] Field of Search ..... 2/445, 428, 430, 2/429, 452, 450; 351/43, 128; 128/858

[56] References Cited

U.S. PATENT DOCUMENTS

| | | | |
|---|---|---|---|
| 4,129,362 | 12/1978 | Lorenzo | 351/128 X |
| 5,313,671 | 5/1994 | Flory | 2/445 X |
| 5,390,373 | 2/1995 | Flory | 2/445 X |

*Primary Examiner*—Peter Nerbun

*Attorney, Agent, or Firm*—Pro-Techtor International Services

[57] ABSTRACT

A nose bridge of swimming goggles includes an elongated member connected between two lens frames of the swimming goggles. Each of the frames has a through hole provided on an inner side thereof to face each other. The elongated member includes a flexible tube having two end sections respectively extending through the holes of the frames with a central section connecting therebetween to define a distance between the two frames. Each of the end sections receives therein a fastener movable within the tube and configured to be releasably engageable with the respective hole for pinchingly fixing the end section of the flexible tube. The fasteners are movable along the tube by squeezing the flexible tube to drive the fasteners to move so as to adjust the distance defined by the central section of the flexible tube, thus resulting in a more comfortable contact engagement and a better leakage proof engagement between the goggles and wearer's face.

4 Claims, 5 Drawing Sheets

NOSE BRIDGE STRUCTURE OF SWIMMING GOGGLES

FIELD OF THE INVENTION

The present invention is related generally to swimming goggles and in particular to an improved nose bridge of the swimming goggles which provides a more comfortable contact engagement of the goggles with the face of the wearer and a better leakage proofness therebetween.

BACKGROUND OF THE INVENTION

Swimming goggles are comprised of two lens frames which are connected to each other by means of a nose bridge which is designed to straddle over the nose of the wearer. The nose bridge of some of the swimming goggles is also designed to adjust the distance between the lens frames to provide a comfortable engagement between the lens frames and the wearer's face. A conventional adjustable nose bridge is illustrated in FIG. 1 of the attached drawings, which comprises an elongated strip 60 having two opposite ends respectively received within and engaged by holding slots provided on the lens frames. Each of the ends of the elongated strip 600 is provided with a plurality of ribs or ridges 601, usually three such ribs 601 on each of the ends, to provide a secure engagement between the strip 60 and the frames. The ribs 601 allows the strip 60 to be secured to the frames at different position so as to achieve adjustment of the distance between the frames. Since there are only limited ribs 601 formed at each of the ends of the strip 60, there are only limited discrete adjustment of the relative position of the strip 60 with respect to the frame may be made. Such a limited adjustability of distance between the frames may sometimes not be able to provide a comfort engagement and a leakage proof contact between the goggles and the wearer's face.

There is also a prior art design of swimming goggles which are provided with three different-sized nose bridges to be selectively mounted on the swimming goggles in order to provide three different distances between the frames. Such a design provides only limited adjustability of the distance between the frames. Further, an increased inventory is needed in warehousing the three different-sized nose bridges. This is not only inconvenient, but also more costly.

It is thus desirable to provide a swimming goggle nose bridge structure which allows a better adjustability of distance between the frames of the swimming goggles so as to overcome the drawbacks of the prior art designs.

SUMMARY OF THE INVENTION

Therefore, a primary object of the present invention is to provide a swimming goggle nose bridges structure wherein is steplessly adjustable so as to provide a fine adjustment of the distance between the frames in accordance with the facial configuration of the wearer, resulting in a more comfortable and better leakage proof engagement between the goggles and the wearer's face.

Another object of the present invention is to provide a swimming goggle nose bridge structure which is ready to adjust by simply squeezing with the wearer's hand(s).

A further object of the present invention is to provide a swimming goggle nose bridge structure which has a single size fit for different goggle sizes so as to reduce the cost of inventory and simplify the management of inventory parts.

To achieve the above object, there is provided a swimming goggle nose bridge structure, wherein the nose bridge comprises an elongated flexible tube having two ends respectively received within a hole formed on each of the frames to connect the frames together. The flexible tube receives two fasteners therein in a movable manner. The fasteners are provided with wedging sections to engage the holes so as to pinchingly secure the flexible tube in position with respect to the frames. Adjustment of the distance between the two frames is achieved by hand squeezing the flexible tube to force the fasteners to move relative to the tube so as to reduce or increase the distance between the frames. Such an adjustment is stepless so as to provide a more comfortable engagement of the frames of the goggles with the wearer's face.

In accordance with the above described swimming goggle nose bridge structure, the fastener may have a narrow end and an opposite wide end, both being tapering away from each other. The narrow end of the fastener provides an easy insertion of the fastener into the hole, while the wide end of the fastener provides a secure engagement between the hole and the fastener due to the wedging action caused by the tapering configuration thereof.

The object, advantages and features of the present invention will be apparent from the following description of preferred embodiments, with reference to the attached drawings, wherein:

DETAILED DESCRIPTION OF THE PREFERRED EMBODIMENTS

Figure 1:
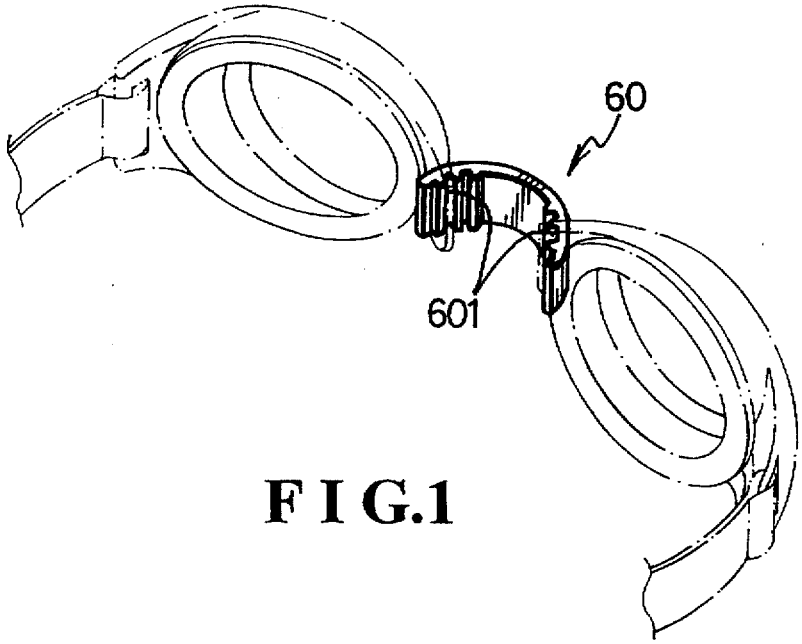
FIG. 1 is a perspective view showing a prior art nose bridge adapted in a pair of swimming goggles.
Figure 2:
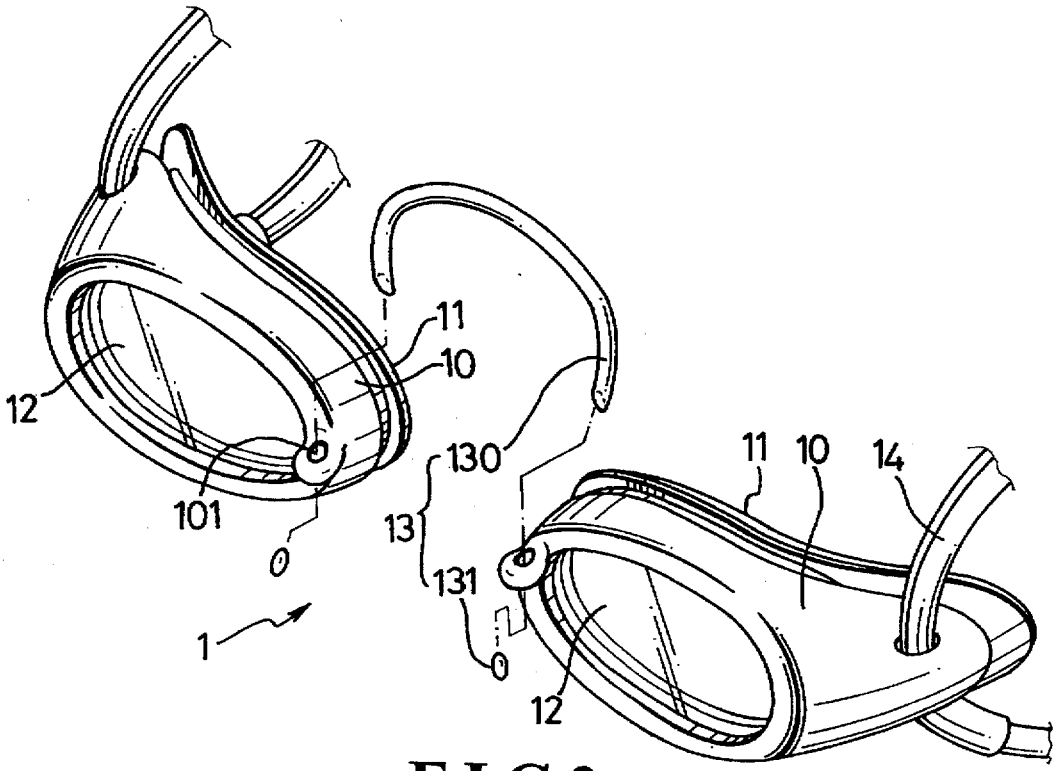
FIG. 2 is an exploded perspective view showing a pair of swimming goggles which incorporate a nose bridge constructed in accordance with a first embodiment of the present invention.
Figure 3:
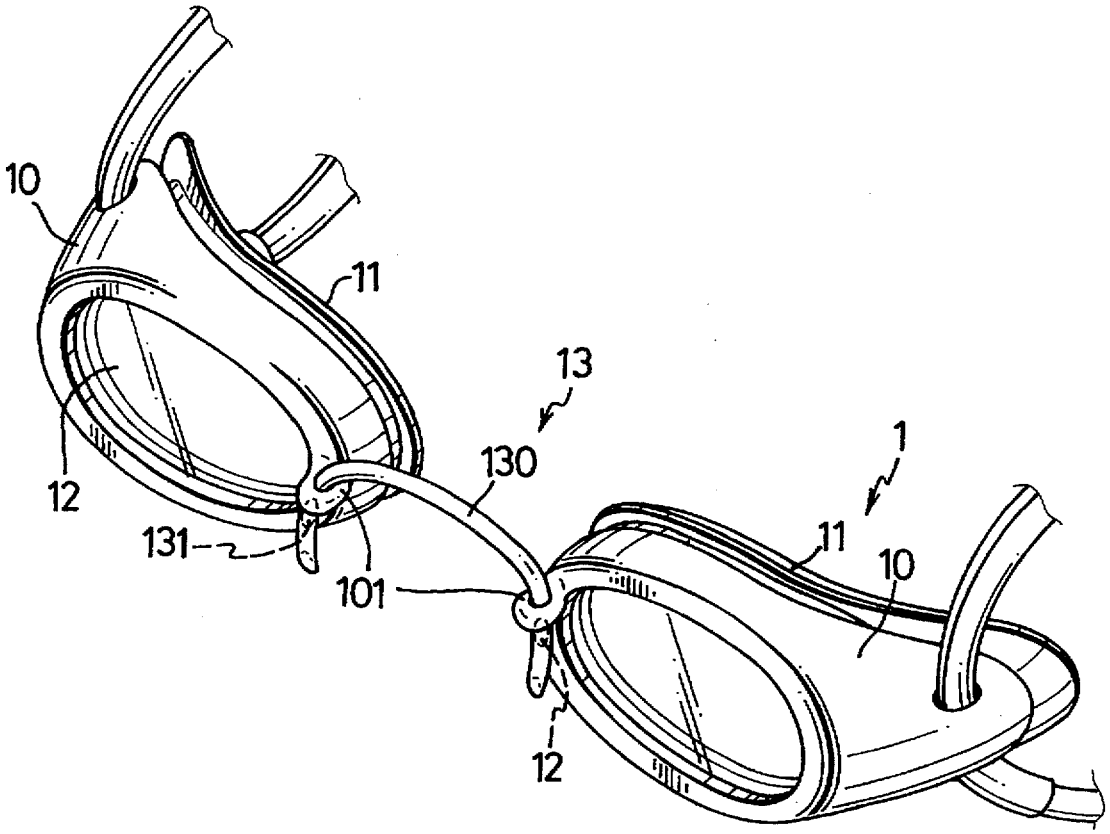
FIG. 3 is a perspective view of the swimming goggles shown in FIG. 2.

Referring to the drawings and in particular to FIGS. 2 and 3, wherein a pair of swimming goggles 1 are shown, the swimming goggles 1 comprise two lens frames 10, each having a cushion pad 11 preferably integrally formed with the frame 10 and a lens 12 fixed within a receiving bore defined within each of the frames 10. The swimming goggles 1 also comprise a nose bridge 13 connecting between the inner sides of the frames 10 and a head strip 14 connecting between the outer sides of the frames 10. The frames 10, the cushion pads 11, the lenses 12 and the head strip 14 all have a structure similar to any known prior art design and do not constitute any part of the present invention so that no detail is needed herein. The present invention resides on the improvement of the nose bridge 13, which may be adapted in any kind of swimming goggles, not limited to what is described and illustrated herein.

Figure 4:
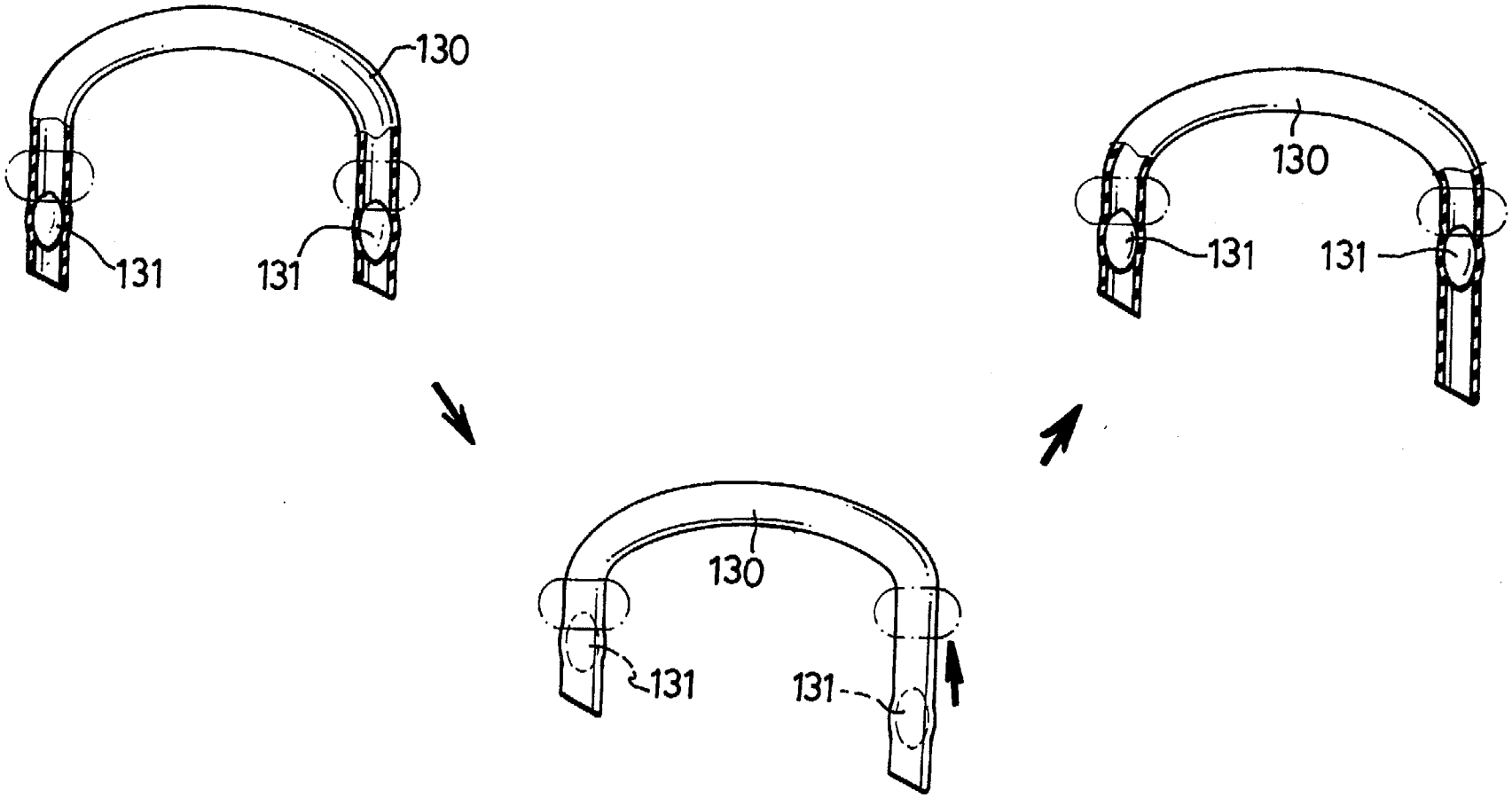
FIG. 4 is a schematic view showing the operation of adjustment of the nose bridge in accordance with the present invention.

The nose bridge 13 adapted in the swimming goggles 1 shown in FIGS. 2 and 3 is constructed in accordance with a first preferred embodiment of the present invention, comprising a tubular member 130 and two fasteners 131 sized to be receivable within the tubular member 130. The tubular member 130 comprises a flexible tube having two ends respectively extending through a through hole 101 formed on the inner side of each of the frames 10 of the swimming goggles 1, preferably on an extension on the inner side, so as to imaginatively divide the tubular member 130 into two end sections and one central section separated by the holes 101 of the frames 10 with the central section of the tubular member 130 defining a distance between the two frames 10. Preferably, the tubular member 130 is received within the through holes 101 in a manner to be substantially parallel with the face of a wearer (not shown) of the swimming goggles 1, but it may not need to be so. The through holes 101 may be circular or elliptic. The ends of the tubular member 130 are open for receiving the fasteners 131 therein and the fasteners 131 are located at the end sections of the tubular member 130. The fasteners 131 have an oval shape, having narrow ends and a wider central section, the ends tapering away from the wider central section. One end of the fastener 131 is oriented toward the hole 101 of the respective frame 10 and facilitates the insertion of the fastener 131 into the hole 101 in order to pinchingly secure the tubular member 130 with respect to the hole 131 by means of the wedging action provided by the oval shape. Thus, by squeezing the tubular member 130 to drive the oval fasteners 131 to move relative to the holes 131, the distance between the two frames 10 is adjusted accordingly, as shown in FIG. 4. Such an arrangement allows a fine adjustment of the distance between the frames 10 to be performed by squeezing the tubular member 130 to move the fasteners 131 so that an improved compliance of the two frames 10 to the facial configuration of the wearer of the swimming goggles 1 and a better leakage proof contact engagement therebetween may be achieved by the fine adjustment of the distance between the two frames 10.

Figure 5:
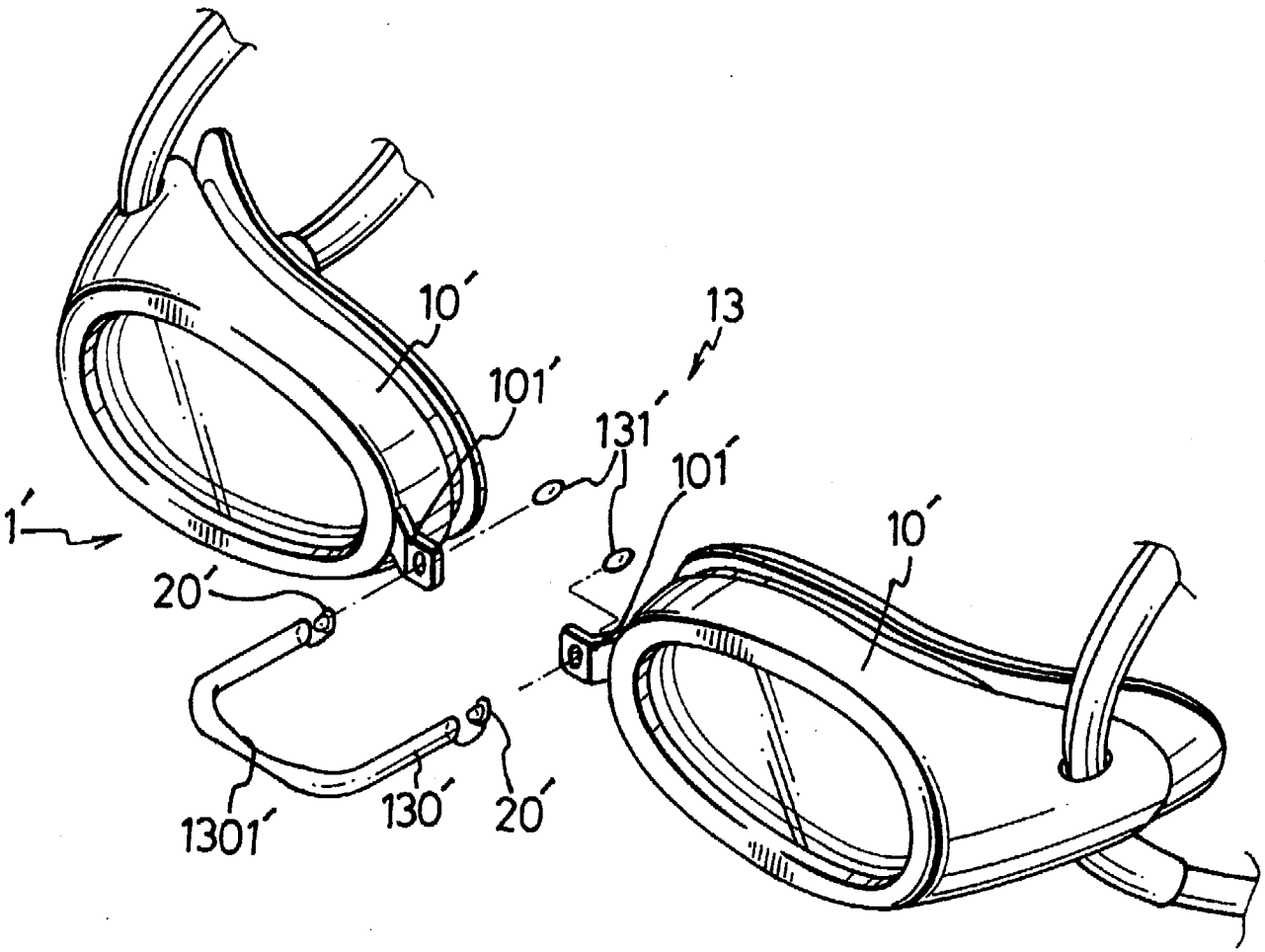
FIG. 5 is an exploded perspective view showing a pair of swimming goggles which incorporate a nose bridge constructed in accordance with a second embodiment of the present invention.

In accordance with a second embodiment of the present invention which is illustrated in FIG. 5 wherein all the members and parts that are counterparts with respect to the first embodiment illustrated in FIGS. 2 and 3 are designated with the same reference numerals but with a prime added for distinction, the nose bridge which is designated with reference numeral 13' comprises two end plugs 20' to be securely fit into and received within the open ends of the tubular member 130' in order to prevent the fasteners 131' from un-expectedly getting out of the tubular member 130'. Further, in the second embodiment, the tubular member 130' is received within the through hole 101' of the respective frames 10' in such a manner to be substantially perpendicular to the wearer's face by moving the ends of the tubular member 130' toward the wearer's face in a direction normal thereto. Further, the central section of the tubular member 130' that defines the distance between the inner sides of the two frames 10' is provided with a concave configuration 1301' facing the wearer's nose in order to provide a more comfortable engagement between the nose bridge 13' and the wearer's nose.

Figure 6A:
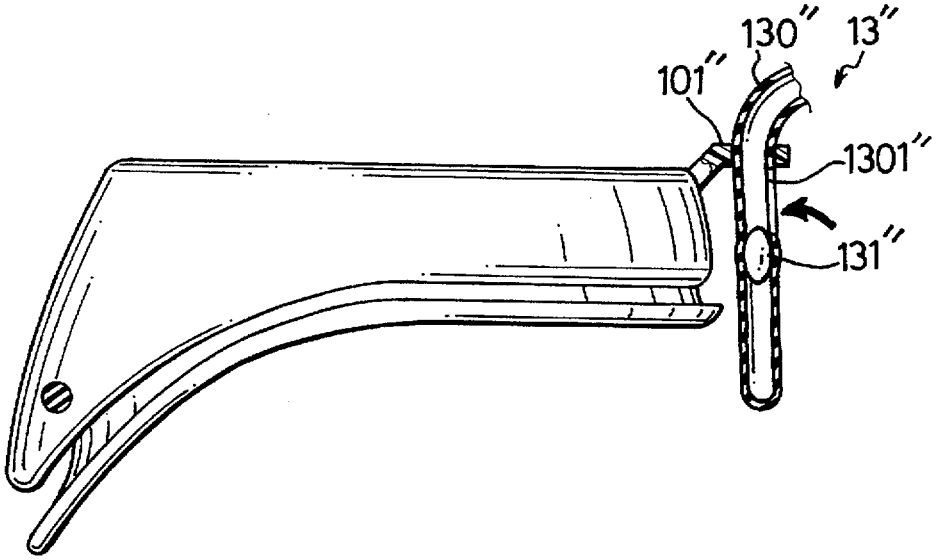
FIGS. 6A and 6B are top views of a portion of a pair of swimming goggles in which a nose bridge constructed in accordance with a third embodiment of the present invention is incorporated with the nose bridge being partially shown and sectioned.
Figure 6B:
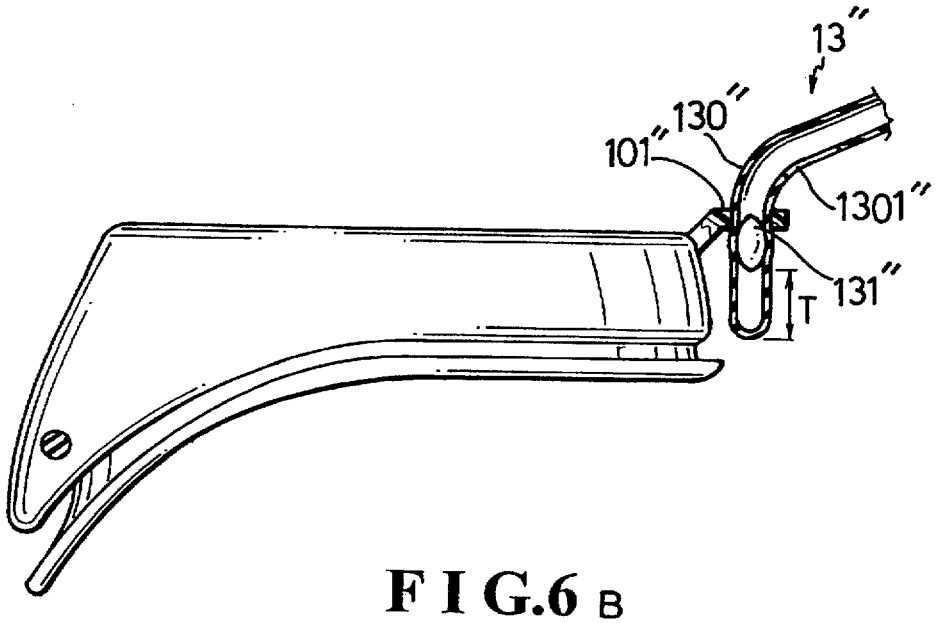

In FIGS. 6A and 6B, a third embodiment in accordance with the present invention is shown, wherein like reference numerals are used to designate similar or identical parts, but with a double prime added thereon for distinction. In the third embodiment, the ends of the tubular member 130" of the nose bridge 13" are closed (only one of the ends being shown in FIGS. 6A and 6B), rather than open as illustrated in the first and second embodiment discussed above, and instead, two lateral openings 1301" are formed on the tubular member 130" at positions away from the ends to receive the oval fasteners 131" into the tubular member. As shown in FIG. 6A, in mounting the nose bridge 13" to the frames, each of the ends of the tubular member 130" is first inserted through the hole 101" of the respective frame until the respective lateral opening 1301" reaches the opposite side of the hole 101". The fastener 131" is fit into the tubular member 130" through the lateral opening 1301" and moved to the respective end section of the tubular member 130". Thereafter, as shown in FIG. 6B, the tubular member 130" is pulled in an opposite direction to have the lateral opening 1301" move back to the side opposite to the fastener 131" so as to securely hold the fastener 131" within the end section of the tubular member 130" and thus allowing the fastener 131" to do fine adjustment within a portion (designated by "T" in FIG. 6B) of the end section of the tubular member 130".

In view of the above description, the swimming goggle nose bridge in accordance with the present invention has the following advantages:

(1) providing an easy adjustment operation by squeezing the tubular member to finely move the fastener by hands;

(2) providing a stepless adjustment of the distance between the frames so as to better suit the facial configuration of a wearer of the swimming goggles; and (3) providing an easy and ready mounting and adjustment operation by directly inserting the tubular member through the hole formed on the frames and squeezing the tubular member to achieve mounting and adjustment operation.

The above description is made with respect to the preferred embodiments of the present invention and for those skilled in the art, it is possible to made a variety of modifications and changes to the above-described specific embodiments without departing from the scope and spirit of the present invention. All these modifications and changes should be considered within the scope of the present invention as defined in the appended claims.

What is claimed is:

1. A nose bridge of swimming goggles, comprising:

an elongated member adapted to connect between two lens frames of the swimming goggles, each of the frames having a through hole provided on an inner side thereof to face each other, the elongated member comprising a flexible tube having two end sections respectively adapted to extend through the holes of the frames with a central section connecting therebetween to define a distance between the two frames, each of the two end sections having an oval fastener positioned therein and movable within the tube and configured to be releasably engageable with the respective hole for pinchingly fixing the end section of the flexible tube, a narrow end of the fastener being sized to be readily fit into the respective hole to engage therewith by means of a wide section the fastener, the fastener being movable along the tube by squeezing the flexible tube to drive the fastener to move so as to adjust the distance defined by the central section of the flexible tube, and wherein the ends of the flexible tube are closed and each of the end sections of the flexible tube comprises a lateral opening away from the end for receiving the fasteners therein, thus resulting in a more comfortable contact engagement and a better leakage proof engagement between the goggles and wearer's face.

2. The nose bridge of the swimming goggles as claimed in claim 1, wherein the central section of the flexible tube comprises a concave configuration corresponding to the shape of a nose.

3. A swimming goggle structure, comprising;

a pair of lens frames, each defining a lens receiving bore and a connecting extension;

a pair of lenses, respectively received and held within the lens receiving bores of the frames;

a nose bridge comprising a flexible tube having two end sections respectively extending through a hole formed on a respective connecting extension of each lens frame with a central section connecting between the two end sections for defining a distance between the two frames, two oval fasteners, each fastener being respectively received within the end sections to releasably engage a respective hole to fix the flexible tube with respect to each respective hole, a narrow end of each fastener being sized to be readily fit into the respective hole, and the ends of the flexible tube are closed and each of the end sections of the flexible tube comprises a lateral opening away from the end for receiving the fastener therein; and a head strip connecting the two frames to be opposite to the nose bridges.

4. The nose bridge of the swimming goggles as claimed in claim 3, wherein the central section of the flexible tube comprises a concave configuration corresponding to the shape of a nose.

* * * * *